US005878378A

United States Patent [19]

Brommer et al.

[11] Patent Number: 5,878,378

[45] Date of Patent: Mar. 2, 1999

[54] BOOT BALANCE TRAINING DEVICE

[75] Inventors: Karl D. Brommer, Hampton Falls; Peter J. Schibly, Litchfield; Thomas G. Hebert, Merrimack, all of N.H.

[73] Assignee: Mountain Dynamics, Inc., Hampton Falls, N.H.

[21] Appl. No.: 760,492

[22] Filed: Dec. 5, 1996

[51] Int. Cl.[6] ..... A63C 5/06; A43B 5/04

[52] U.S. Cl. ..... 702/139; 702/150; 340/573; 340/686

[58] Field of Search ..... 364/550, 556, 364/558, 506; 36/88, 54, 117.7, 117.9, 118.1, 115, 116, 117.1, 117.6, 50.5, 117.3, 117.5, 118.2, 118.8, 93, 118.9, 132, 139, 69; 280/11.3, 611, 617, 623, 634; 473/269; 340/573, 407.1, 686, 691; 434/253; 482/8, 71; 601/33; 702/150, 139

[56] References Cited

U.S. PATENT DOCUMENTS

| | | | |
|---|---|---|---|
| 4,372,062 | 2/1983 | Tringali | 36/117.5 |
| 4,465,295 | 8/1984 | Spademan | 280/612 |
| 4,813,436 | 3/1989 | Au | 600/592 |
| 5,033,291 | 7/1991 | Podoloff et al. | 73/172 |
| 5,265,350 | 11/1993 | MacPhail | 36/117.9 |
| 5,323,650 | 6/1994 | Fullen et al. | 73/172 |
| 5,566,479 | 10/1996 | Gray et al. | 43/42.16 |
| 5,592,401 | 1/1997 | Kramer | 702/153 |
| 5,636,855 | 6/1997 | Couderc et al. | 280/602 |
| 5,678,448 | 10/1997 | Fullen et al. | 73/172 |

*Primary Examiner*—James P. Trammell
*Assistant Examiner*—Cuong H. Nguyen

[57] ABSTRACT

A balance training device for sports such as skiing and skating uses force sensors located to sense forward pressure between a boot and the wearer thereof and electrical components to generate immediate feedback to the wearer.

9 Claims, 12 Drawing Sheets

BOOT BALANCE TRAINING DEVICE

BACKGROUND OF THE INVENTION

1. Field of the Invention

The present invention is an electronic training device for activities where fore and aft foot balance is important and is particularly relevant to such activities where an audible indication of such balance is useful.

2. Discussion of Background and Material Information

Maintaining correct balance in the form of an athletic stance with the weight centered in the fore/aft direction is important in many athletic activities. In skiing, correct longitudinal balance is necessary to drive the forward inside metal edge into the snow in order to steer the ski through a carved turn. By maintaining pressure against the front of the boot, the skier's weight and isometric force from knee flexion is applied to the ski's carving edge. This action generates the pressure necessary to engage the forward metal edge of the ski into hard snow, thereby maintaining control of the ski. Other sports such as snowboarding, ice skating and in-line skating require similar forward balance.

Most novice and some moderately proficient skiers exploit the extended length of a ski behind the boot to successfully negotiate terrain with an incorrect stance, specifically a stance where excessive pressure is applied to the rear of the boot and consequently to the rear of the ski. As described by Witherell and Evrard in The Athletic Skier, this incorrect stance is made possible by the large amount of leverage provided by the rear section of the ski. This so-called "invisible foot" enables skiers to skid down steep slopes by dragging the tails of the skis against the snow. This method, while effective to a limited extent, is both incorrect and dangerous. The method is incorrect because the loss of forward pressure on the ski limits the amount of control available to the skier for steering, negotiating hard snow and for handling sudden increases in the pitch of the slope. The practice of leaning back on the skis is dangerous because loss of control from a rear-weighted position may result in the skier falling over the back of the skis. This form of accident has been known to sever the connection of the anterior cruciate ligament to the tibia, the most common form of injury in skiing.

The ability to apply correct forward pressure to a ski is a difficult skill to learn because it runs counter to the defensive instinct of leaning backward when encountering a steep or icy slope. Beginning skiers have difficulty mastering the concept because much practice is required to develop a feel for correct balance on a ski on slopped terrain. Even advanced racers have difficulty maintaining the skill at high speeds on a difficult race course. The undesirable trait of leaning back on the skis is known in the race community as "riding in the back seat."

Traditional ski instruction methods are not suitable for overcoming this problem. Skiing balance is particularly difficult to observe when a skier is headed downhill because the force vector generated by gravity on a skier's center of mass does not pass through the skier's boots. It is difficult for an athlete or a beginner to know when the correct weight is being applied because no direct measurement exists. Specifically, no device exists to continuously monitor the correct forward pressure of an athlete while skiing down a hill.

Similar advantages accrue to the snowboarder, ice skater or in-line skater who maintains a correct forward stance in these sports. In each case a loss of control and potential hazard exists when the athlete succumbs to the defensive instinct of learning back in a defensive posture.

Various methods of measuring and monitoring the performance of an athlete in a laboratory setting are known in the art These devices use mechanical and electrical means to measure the dynamics of runners, skiers and other athletes. These tend to use force pads, or sensors with wires running from the test subject to static laboratory equipment. The use of video analysis is also extensively documented.

U.S. Pat. No. 5,221,088 to McTeigue, et al. describes means for measuring weight distribution in sports such as golf or baseball where the athlete engages in a static stance before swinging an object at a ball. Sensors in each shoe produce a signal proportional to the amount of weight placed thereon. The signals are sent to a computer which compares each against a separate predetermined range of values. This predetermined range is a selectable percentage of a maximum value, which is calibrated to a person's weight. Various audio signals are generated in response to the comparison to provide feedback for a variety of training algorithms. The usefulness of this device for measuring weight distribution among different sensors in a single shoe is noted.

Marsh describes in U.S. Pat. No. 5,471,405 a device to record forces applied to garments including shoe soles, shoe liners and gloves. A weight sensor in each shoe is constantly sampled and the data is wirelessly transmitted to a display processor unit Information on the intensity and duration is provided to the user, such as a runner or golfer.

U.S. Pat. No. 4,516,110 issued in May 1985 to Overmyer describes a method of measuring the relative bend of the front and rear portions of a ski by the use of strain gages which are bonded to those portions of a ski. The Overmyer device is self-contained on the athlete, with means to provide continuous feedback during a skiing performance without external observation or equipment.

Static devices applicable to teaching a skiing stance are described in several patents. U.S. Pat. No. 4,092,787 issued to Kaempfen describes a static fixture for practicing ski turns. Campbell, III in U.S. Pat. No. 4,694,684, describes a static fixture for measuring the longitudinal balance point of a specific skier on a specific pair of skis intended for use in refining the location of the binding position.

U.S. Pat. 4,813,436 issued to Au describes a system capable of monitoring the amount of pressure simultaneously exerted on a plurality of sensors by the sole of a person's foot and simultaneously displaying those forces while the person uses a treadmill.

Ratzlaff et al in U.S. Pat. No. 4,814,661 describes a system for measuring forces generated by the plantar surface of a human foot using several piezoelectric transducers located under the foot and including means for displaying the instantaneous forces simultaneously measured.

Several additional patents describe methods for enclosing force measurement instrumentation on a shoe. U.S. Pat. No. 4,649,552 issued to Yukawa describes an electronic pedometer where a step sensor in the sole of a shoe triggers a counter unit mounted on the laces. U.S. Pat. No. 4,703,445 issued to Dassler describes a sensor for measuring the speed of and distance covered by a running shoe. U.S. Patent No. 5,323,650 issued to Fullen et al describes the use of a sensor array embedded in a shoe sole for measuring forces applied to specific locations of the foot with greater resolution. The invention of Thomas et al in U.S. Pat. No. 5,253,654 uses a strain gage mounted in a shoe to monitor the weight applied to a lower extremity for orthopedic purposes.

Several other patents describe sensors applicable to human force measurement. In U.S. Pat. Nos. 4,734,034 and No. 4,856,993 both issued to Maness et al, means are described to measure points of contact in dental occlusion. Podoloffet al in U.S. Pat. No. 5,033,291 describes a flexible sensor for uses in applications where shear forces are encountered and sensor thickness is a consideration.

SUMMARY OF THE INVENTION

Accordingly, it is an object of the present invention to provide a device for sensing the forward lean pressure produced by an active athlete on an athletic shoe or boot.

It is a further object of the present invention to provide such a device which differentiates the amount of forward lean pressure so applied from the amount of rearward pressure which is simultaneously applied.

It is a still further object to provide such a device which produces an audio feedback signal in response to the differential amounts of forward and rearward pressure simulataniously applied to an atheletic shoe or boot.

It is a still further object to provide such a device which differentiates forward and rearward pressure with a variable threshold to accomodate athletic training at various skill levels.

It is a still further object of the present invention to provide such a device which is portable and removable to tollerate temporary installation on a variety of different users.

It is a still further object of the present invention is to provide a self-contained sensor capable of measuring forward athletic balance in a variety of sports, including skiing, skating and snowboarding.

Other objects and advantages will become clearer upon reading the description that follows.

In one form, the present invention provides a foot balance training device, comprising first and second force sensitive resistors, means for affixing the first and second force sensitive resistors for sensing forward pressure exerted between a person's foot or leg and footwear means being worn by the person with the first force sensitive resistor, and for sensing rearward pressure exerted between the foot or leg and the footwear means with the second force sensitive resistor, means responsive to the first and second resistors for generating a signal indicative of the greater of either the forward or rearward pressure sensed by the first and second resistors, and signal means responsive to the means for generating for communicating to the person wearing the footwear means the greater of either the forward or rearward pressure sensed by the first and second resistors.

BRIEF DESCRIPTION OF THE DRAWINGS

The present invention is illustratively described in reference to several embodiments shown in the accompanying drawings.

FIG. I illustrates an overview of the forward pressure sensors mounted on an ankle inside a ski boot.

DETAILED DESCRIPTION OF THE PREFERRED EMBODIMENTS

Figure 1:
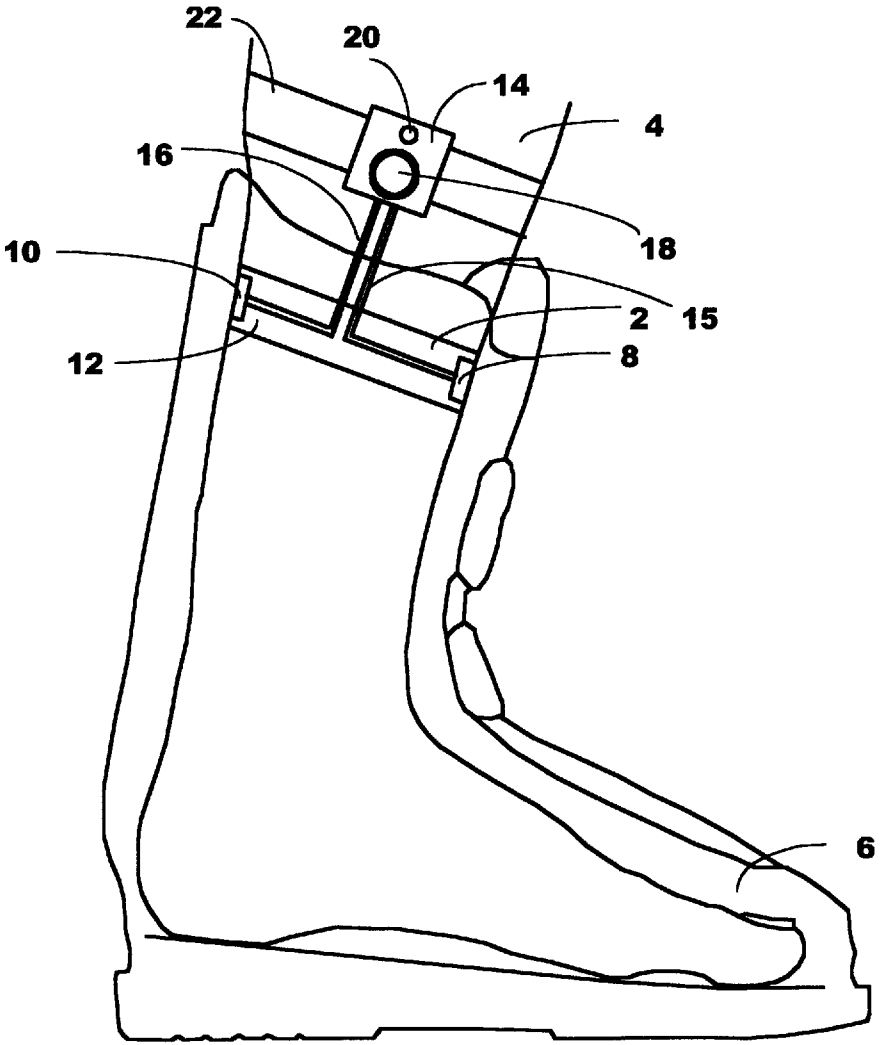

FIG. 1 shows a side view of a boot balance training device 2 worn on a leg 4 of a skier. A ski boot 6 is shown in outline, also on the athlete's leg 4. Training device 2 includes a forward pressure sensor 8 and rearward pressure sensor 10 enclosed in an elastic material 12 wrapped around the athlete's leg 4. Also included are a control unit 14 and two pairs of wires 15, 16 connecting the respective sensors 8,10 to control unit 14. Control unit 14 includes a control knob 18 and an aperture 20 for emitting audio signals and is also secured to the skier's leg using an elastic material 22. Sensors 8 and 10, and all force sensors referred to herein, consist of force sensitive resistors, whose resistance value decreases as the force applied thereto increases.

In operation, tightly fastening the boot 6 engages both sensors 8,10 to measure forward and rearward pressure applied by the athlete's leg 4 while skiing. A comparator circuit within control unit 14 measures the difference in force applied to the two sensors 8,10 and compares the difference to a threshold which is adjustable through control a knob 18. Audio feedback is emitted through aperature 20 when the pressure difference either exceeds or falls below the threshold, depending on the mode of operation. In this embodiment, control unit 14 is mounted on the athlete's leg 4, but it is also possible to mount control unit 14 on the ski boot 6. The details of control unit 14 are discussed in greater detail below.

In the configuration of FIG. 1, the training device is responsive to the amounts of forward and rearward pressure being exerted by the skier's leg 4 on the boot 6. Any sensed pressure in sensor 8 which is due simply to the tightened ski boot 6 is cancelled by corresponding pressure sensed in the sensor 10. The use of a threshold in comparison against the difference measurement allows the skier to differentiate between mild forward pressure and effective forward pressure. Varying the threshold allows use by skiers of different ability levels. In operation, the resistances of sensors 8,10 are compared to determine the greater thereof. The threshold sets a reference value by which either the forward sensor resistance or the rearward sensor resistance must exceed the other in order to be determined to be greater than the other.

Figure 2:
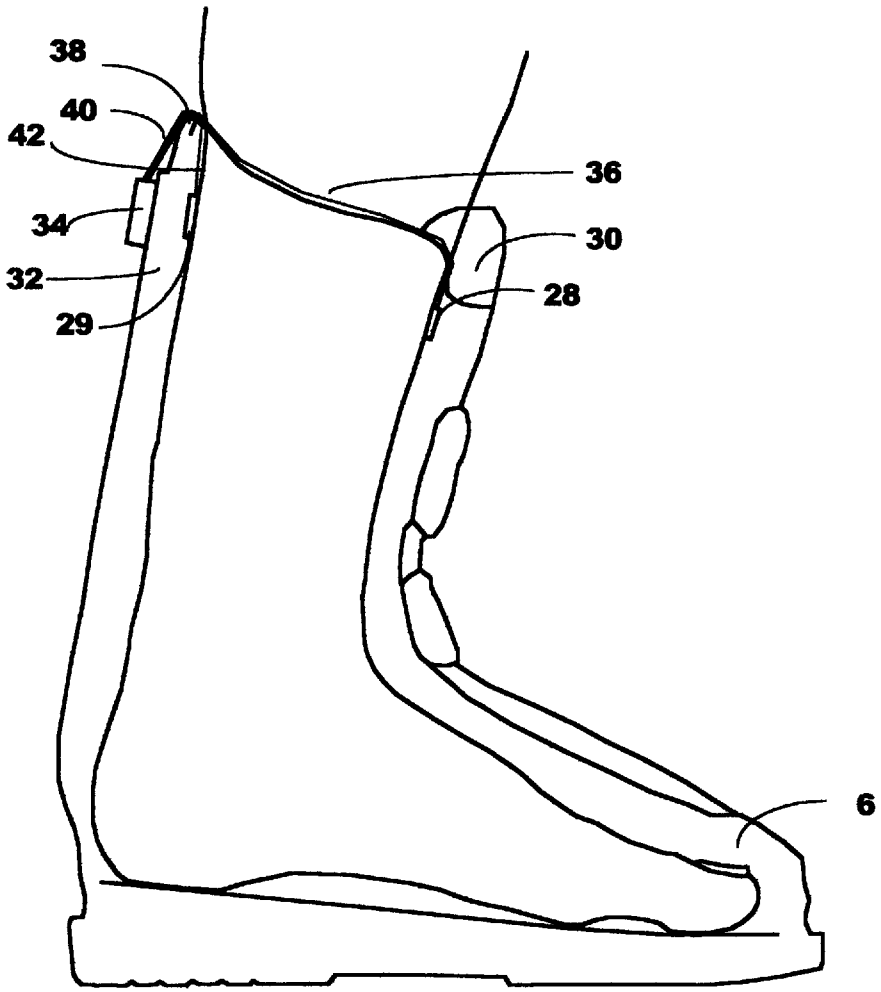
FIG. 2 shows the forward pressure sensors mounted on a ski boot.

FIG. 2 shows a different embodiment wherein pressure sensors 28,29 as well as control unit 34 are affixed to portions of ski boot 6. The forward pressure sensor 28 may actually be embedded within the tongue 30 of boot 6. Altematively, it may be affixed using an adhesive. The rearward pressure sensor 29 is mounted along the rear cuff 32 of the boot 6. Conducting wires 36,40 transmit the sensor signals to the control unit 34, which is shown mounted in the alternative embodiment on the rear outside of the ski boot cuff 32. One possible means of mounting control unit 34 is through a hook 38 on to the rear of the boot 6. As in the embodiment of FIG. 1, tightening the boot 6 engages the force sensors 28, 29 which also function in the same manner as sensors 8,10.

Figure 3:
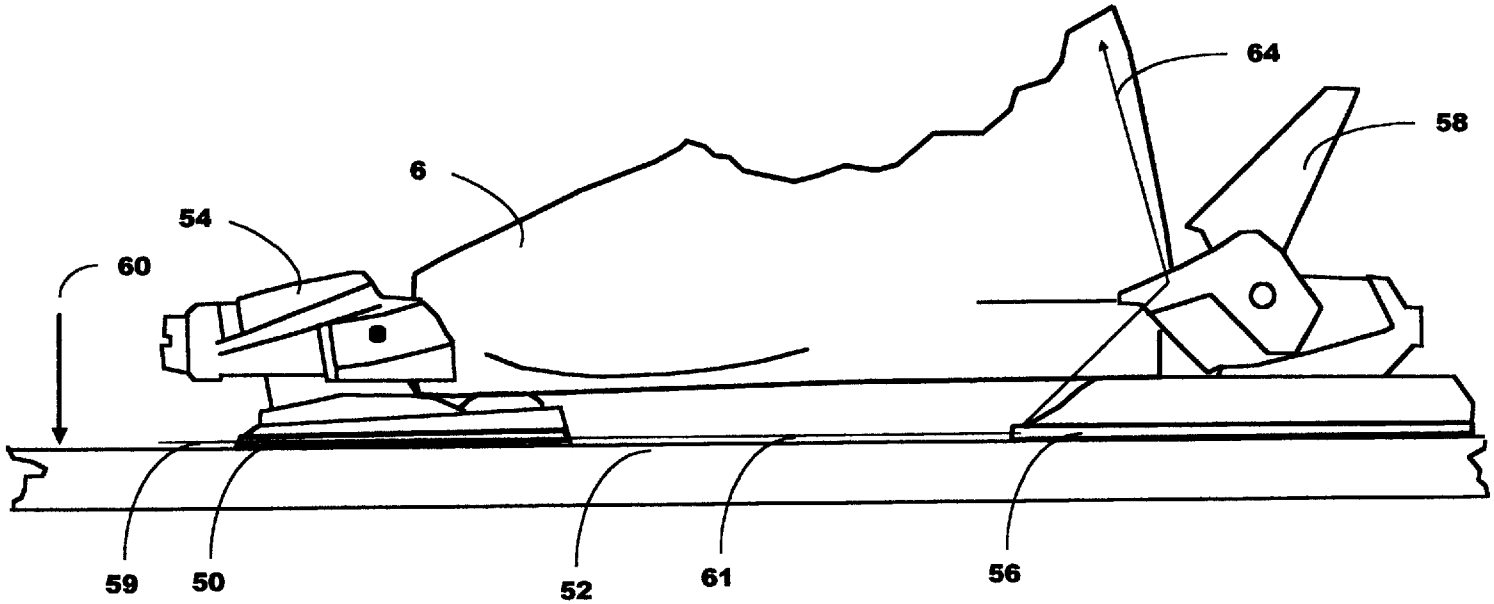
FIG. 3 shows the forward pressure sensors mounted under a ski binding.

FIG. 3 is a further embodiment of the present invention wherein the sensors of the training device are mounted under a ski binding. In this embodiment surface 52 under ressure sensor 50 is mounted on the ski surface 52 under the binding toe piece 54. The rearward pressure sensor 56 is mounted under the binding heel piece 58. Transmission wires 59,61 run along the binding either to a control unit mounting position 60 in front of the binding toe piece or upwards along the boot along path 64 for mounting on the boot as described in FIG. 2 or on the leg as described in FIG. 1. When a control unit is mounted on the front of the toe piece 54, this may be done temporarily using adhesive tape or glue, or permanently using strong glue or mechanical fasteners. Forward pressure due to the skier's weight and knee flexion is transmitted through the front of the boot 6 into the binding toe piece 54, engaging the forward pressure sensor 50. Rearward pressure is transmitted through the rear of the boot into the binding heel piece 58, engaging the rearward sensor 56.

Figure 4:
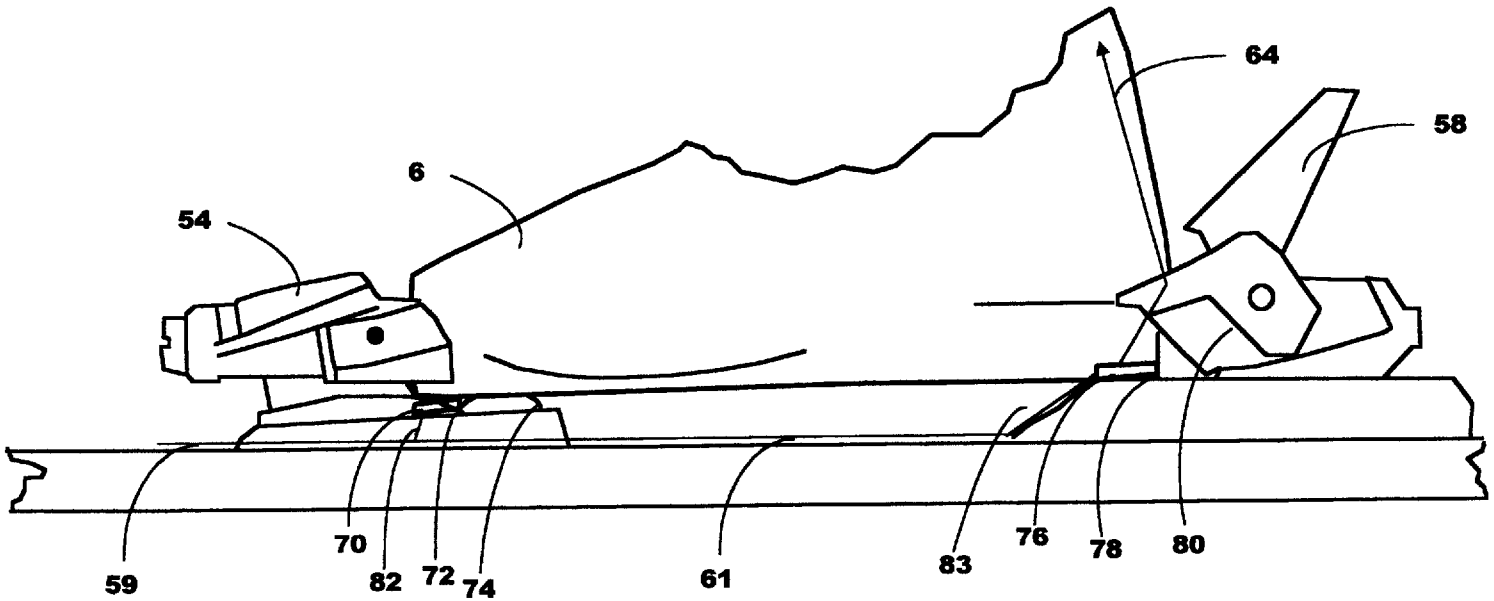
FIG. 4 shows the forward pressure sensors mounted on a ski binding.

FIG. 4 shows locations for temporarily mounting the sensors between the ski boot sole at the tops of the binding toe piece 54 and heel piece 58. A forward pressure sensor 70 is mounted on the flat area 72 of the toe piece 54 in front of an anti-friction pad 74. A rearward pressure sensor 76 is mounted on the flat area 78 of the heel piece 58 directly in front of the heel cup 80. The signal wires 82,83 may be run along any of the paths 59,61,64 described in FIG. 3 and the comparator circuit may be mounted in any of the locations described in FIGS. 1, 2 or 3.

The embodiments of FIGS. 3 and 4, in fact, sense forward and rearward balance pressure due to the lever action caused by the boot 6 being affixed to the bindings 54,58. For example, downward pressure exerted on sensor 50 of FIG. 3 includes a component of forward pressure being exerted by boot 6 because the rear of boot 6 is affixed by binding 58. The forward pressure component sensed by sensor 50 is differentiated from the weight portion of the skier by the comparison with the pressure sensed by sensor 56. Thus a skier's weight component will vary during a ski run, but this differentiation will remove its effect on the forward/rearward pressure determination.

Figure 5:
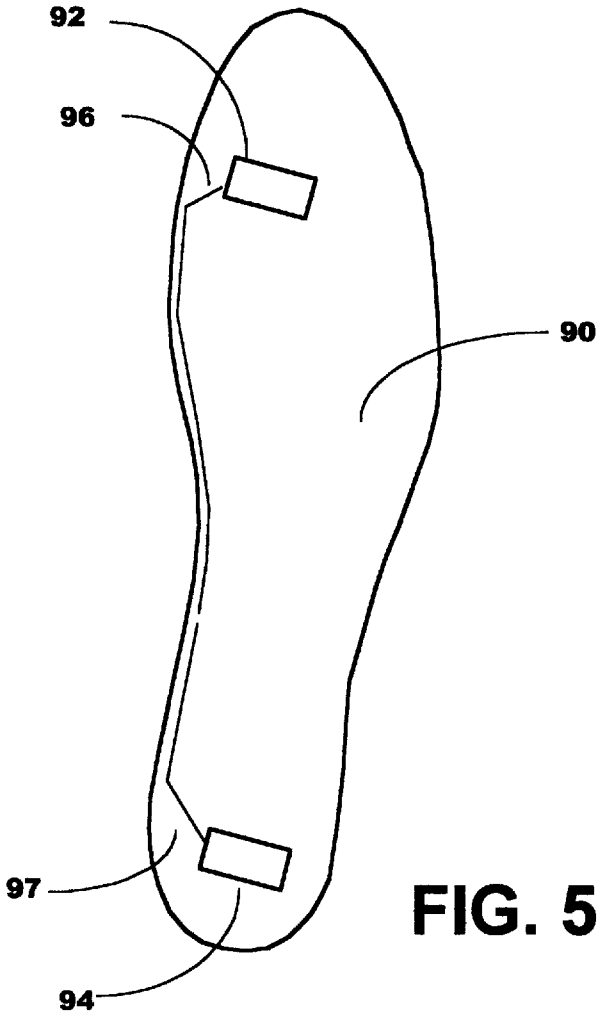
FIG. 5 shows the forward pressure sensors mounted in a shoe inner sole.

FIG. 5 shows an embodiment of the present invention with forward and rearward pressure sensors mounted in a removable inner sole 90. A forward pressure sensor 92 is embedded in the inner sole at the location of the inside of the ball of the foot, approximately between the athlete's first and second metatarsals. A rearward pressure sensor 94 is centered under the athlete's heel. Conducting wires 96,97 transmit the pressure sensor data from the inner sole along the athlete's ankle and leg to a control unit mounted as described in FIGS. 1 or 2. Again, the athlete's weight component will vary during activity but will be factored out by the comparison or subtraction of resistance values between sensors 92 and 94.

Figure 6:
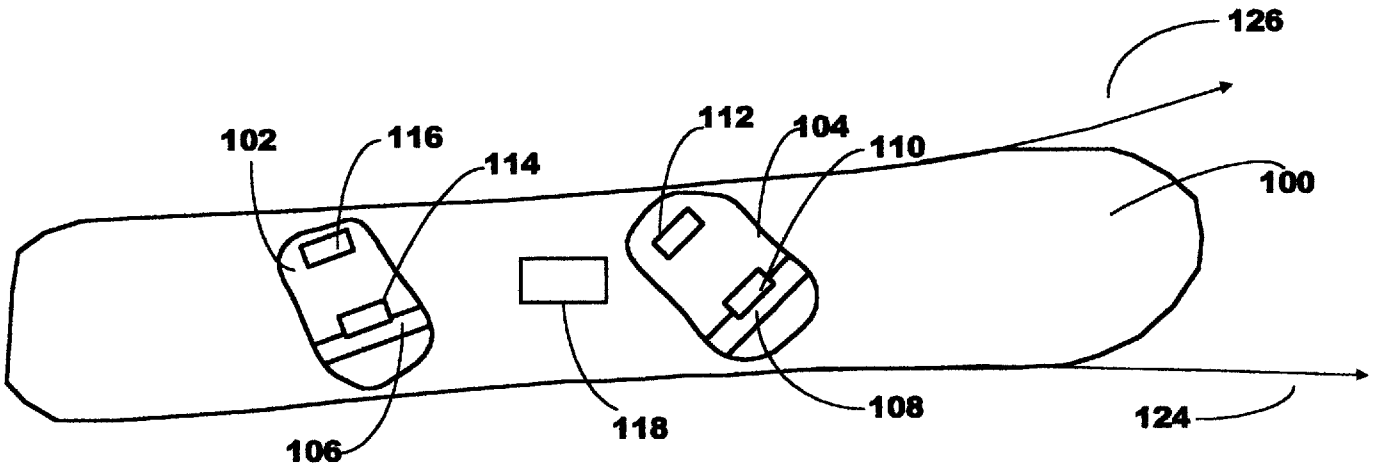
FIG. 6 shows the forward pressure sensors mounted on a snowboard.

FIG. 6 shows the use of the invention on a snowboard 100 with right and left bindings 102,104. Right and left toe straps 106,108 are shown to distinguish the front and rear of the snowboard 100. The forward and rearward sensors may be mounted on or under the left binding 104 in positions 110 and 112 respectively. Alternatively the forward and rearward sensors may be mounted on or under the right binding 102 in positions 114 and 116 respectively. It is also possible to operate the snowboard with a separate pair of sensors mounted underneath each binding. The control unit(s) may be mounted on the snowboard in any convenient location such as location 118. Signals are transmitted from the sensor or sensors through conducting wires along any convenient paths. It is also possible to mount the control units on the athlete's leg or boot as described in FIGS. 1 and 2, respectively. To operate the device on a snowboard, the athlete sets a threshold for the desired degree of forward lean for carving turns along trajectory 124. Alternatively, the athlete may lower the threshold and reverse the comparator polarity to set a threshold appropriate for monitoring rearward lean when carving turns along trajectory 126.

Figure 7:
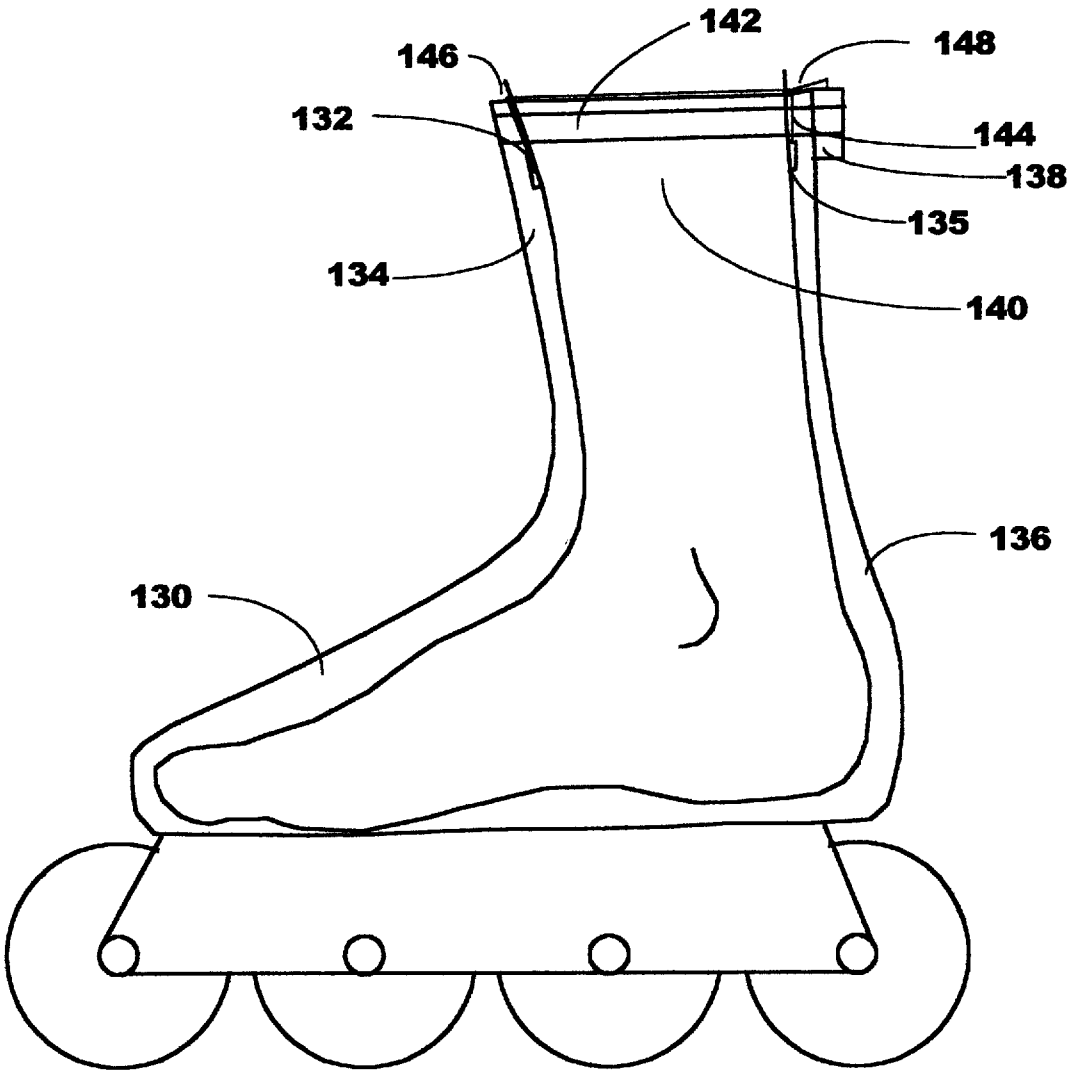
FIG. 7 shows the forward pressure sensors mounted on a skate.

FIG. 7 shows another embodiment of the present invention where the training device is mounted on a skate 130. A forward pressure sensor 132 is mounted on the skate boot tongue 134 using a temporary adhesive. A rearward pressure sensor 135 is mounted along the rear cuff 136. Conducting wires 144,146,148 transmit the sensor signals to a control unit 138 which is shown mounted in the alternative embodiment on the rear outside of the skate boot. One means of mounting the comparator is through a strap 142 around the boot. As in the embodiment of FIGS. 1 and 2, tightening the boot engages the force sensors.

The embodiment of FIG. 7 may also be constituted with the use of the single forward sensor 132 in the same manner as the sensor 8 of FIG. 1.

Figure 8:
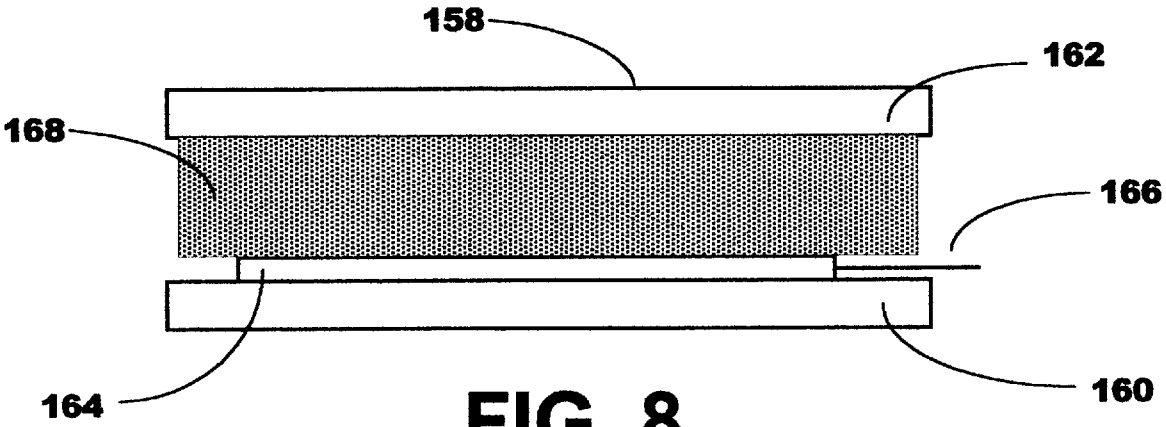
FIG. 8 illustrates the details of the pressure sensor including flexible base plate, elastomer, force-sensitive resistor and mounting material.

FIG. 8 shows the laminated structure of a pressure-sensing element 158 suitable for use with the present invention. Element 158 includes outside layers 160, 162, a force sensitive resistor 164 and an elastomer 168. Outside layers 160 and 162 are rigid plastic stock to protect the sensor, while transmitting force to the force sensing resistor 164 glued or taped to layer 160. A temperature-insensitive elastomer 168 translates the force applied to rigid layer 162 into the operating range of the force-sensing resistor 164. For example, using the resistor 164 in configurations where larger forces are anticipated generally requires a thicker and softer elastomer 168 than configurations where smaller forces are anticipated. In all cases, the elastomer 168 much be chosen to exhibit high resilience and low hysteresis. Low resilience degrades the sensitivity by introducing a relaxation time into the force measurement characteristic of the sensor. High hysteresis leads to unpredictable readings from the sensor after the athlete takes several strides or turns. Neoprene and ethylene-propylene diene are two examples of elastomeric materials with appropriate hardness, resilience, hysteresis temperature stability. Polymers with similar properties are also appropriate. The structure also includes conductive leads 166 from the force sensing resistor to a control unit.

Figure 9A:
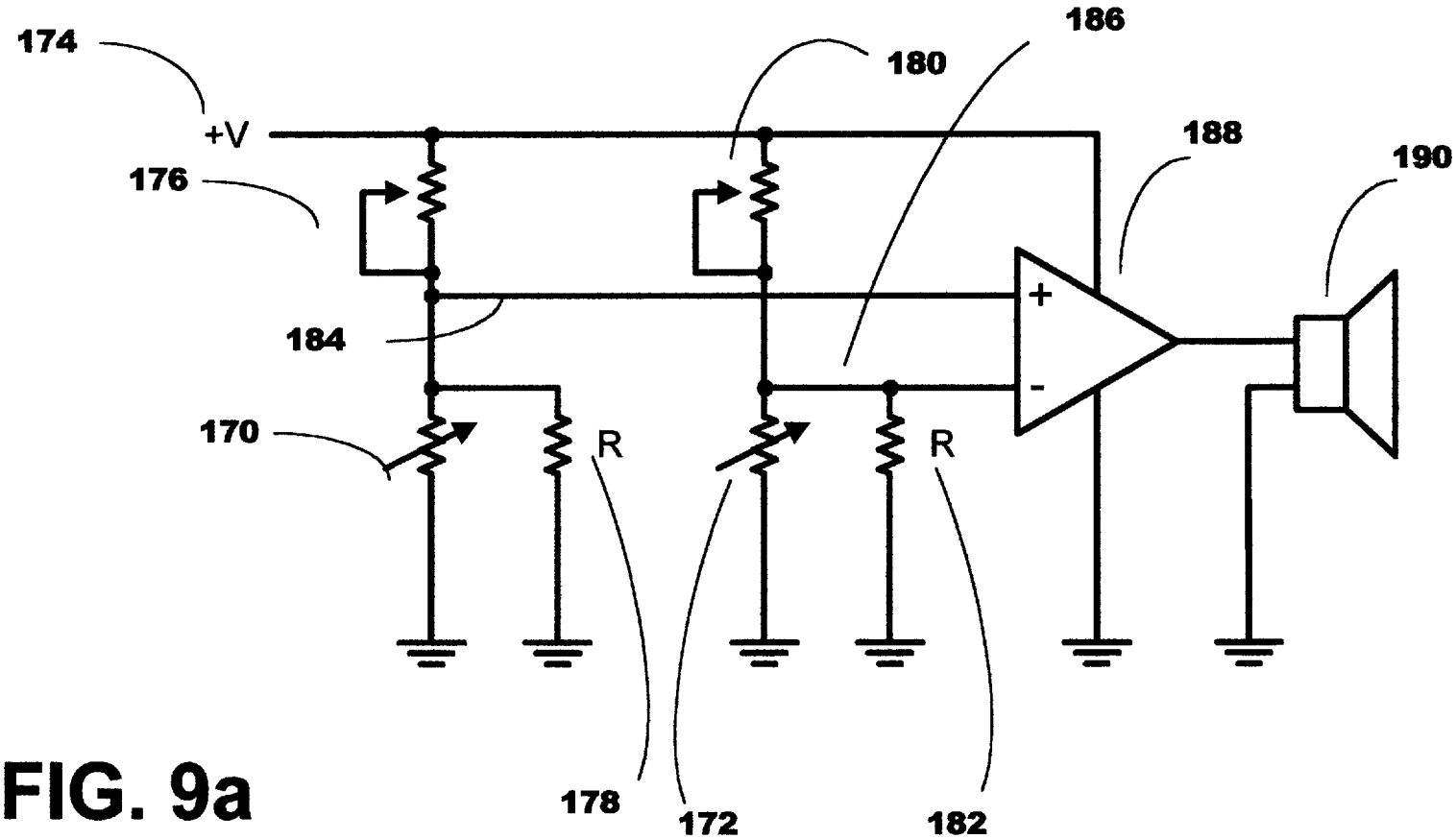
FIG. 9*a* is a schematic diagram of a forward pressure detection and audio feedback circuit suitable for use with the embodiments of FIGS. 1–7.

FIG. 9*a* shows a control unit schematic which may be used with any of the embodiments described thus far. A forward pressure sensor 170 and a rear pressure sensor 172 are shown schematically for clarity even though they would be mounted external to the control unit in a real embodiment. The forward pressure sensor 170 decreases its resistance as the athlete's forward pressure increases. The resistance is converted to a voltage signal 184 by means of a voltage divider across a reference voltage 174. This voltage divider includes a variable threshold resistance 176, the sensor 170 and biasing resistor 178. Resistor 178 prevents voltage 184 from rising to +V 174 when the resistance of pressure sensor 170 rises to infinity due to lack of any sensed pressure thereon. A similar circuit monitors the athlete's rearward pressure, consisting of a rearward pressure sensor 172 which decreases its resistance as the athlete's rearward pressure increases. A voltage signal 186 is created by another voltage divider including a biasing resistor 182, sensor 172 and a variable threshold resistance 180.

In the configuration of FIG. 9*a*, threshold resistances are chosen to excite the audio feedback when the athlete's forward balance falls below a desired value, indicating an insufficiently inclined forward stance. As the athlete leans backwards, the rearward sensor voltage 186 will decrease and the forward sensor voltage 184 will increase. At a threshold sensor resistance difference determined by the settings of variable resistors 176 and 180, the forward sensor voltage 184 will exceed the rearward sensor voltage 186. Since the forward sensor voltage 184 and rearward sensor voltage 186 are respectively input to positive and negative inputs of a comparator 188, at this value the comparator will send a non-zero voltage to the audio amplifier 190. The audio amplifier 190 contains a transducer, providing the athlete with an audio signal indicating that the degree of forward stance has fallen below the desired extent By varying the threshold resistance in variable resistor 176, the athlete may set the degree of forward stance necessary to prevent output from the transducer. In this configuration, the unit is used as a warning device to signal the athlete whenever their stance is weighted too much to the rear.

One clear use of this function is to teach beginning skiers and skaters to learn forward in their boots and thus reduce falls and debilitating knee injuries. A less obvious use of this function is as a self-diagnostic for racers and other advanced skiers to verify that their technique safely forward pressures their skis while performing high speed maneuvers on difficult terrain. If an advanced skier hears the audio signal while negotiating steep slopes, it alerts them to deficiencies in their techniques.

By reversing the comparator inputs so that the forward sensor voltage 184 is the negative comparator input and the rearward sensor voltage 186 is the positive comparator input, the invention may be operated in the mode where the audio output signals the athlete whenever a desired level of forward stance is achieved. This mode provides positive audio feedback to beginning skiers and skaters when they achieve a correct stance on their equipment Increasing the forward pressure threshold provides a means where advanced skaters may use the device to test their ability to achieve a given level of force in their skating strides, as indicated by audio feedback whenever the desired level of force is achieved.

Snowboarders may use the device in either forward or reverse mode, to verify the correctness of their stances on snowboards. By increasing the appropriate thresholds to high levels, snowboarders can use the sensor to test their ability to achieve high degrees of forward or reverse leans during carving turns. The forward lean threshold is set in a manner similar to that described for skaters. The reverse lean threshold is set in the alarm mode shown in FIG. 9*a* and described as a self-diagnostic for skiers. In the case of snowboarding, however, a high degree of reverse lean is desirable for some maneuvers, so the audio signal emanating when the degree of reverse pressure exceeds a threshold is positive feedback on the snowboarder's performance.

Figure 9B:
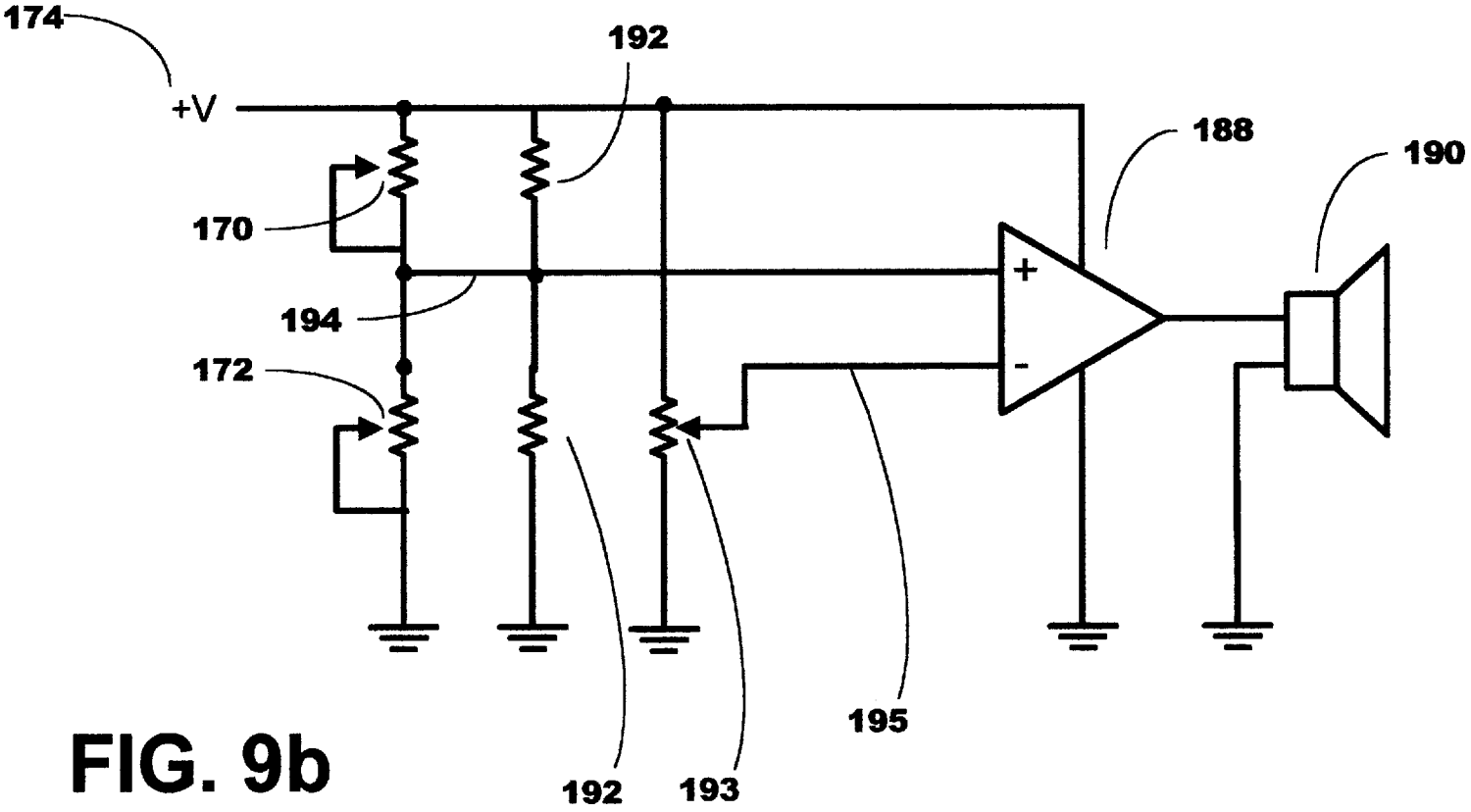
FIG. 9*b* a schematic diagram of a variation of the circuit of FIG. 9*a*.

FIG. 9*b* shows a modified version of FIG. 9*a* wherein similar components are similarly numbered. In this modification the forward pressure sensor 170 and the rearward pressure sensor 172 are connected in series across the voltage V+174. In this manner, their respective resistances, and therefore the respective pressures being exerted thereon, are directly compared. The voltage output 194 created by the voltage divider thus formed is inputed to the positive input of comparator 188. A reference voltage 195 is also created by a voltage divider formed by a center tapped resistance or potentiometer 193, which reference voltage is input to the negative input of comparator 188. A pair of biasing resistors 192 are connected in parallel with sensors 170,172 to control the swing of voltage 194.

In the operation of the circuit of FIG. 9*b*, variable resistor 193 is used to set the threshold voltage for the comparison of sensors 170,172 in various modes of operation. As shown, the circuit will not produce audio feedback whenever sufficiently more pressure is applied to forward sensor 170 than to rearward sensor 172. Likewise, audio feedback will be produced when sufficiently more pressure is applied to the rearward sensor 172 than to the forward sensor 170. Variable resistor 193 can provide the proper reference voltage for both of these modes. The former mode would be used in skiing and skating, whereas the latter mode could be used in snowboarding. Varible skill levels may also be monitored by the level of reference voltage 195.

The circuit of FIG. 9*b* may also be used in the positive feedback mode for beginner skiers and skaters by the reversal of the circuit positions of sensors 170 and 172. Thereby audio feedback would be produced whenever suffiently more pressure is applied to forward sensor 170 than to rearward sensor 172.

Figure 10:
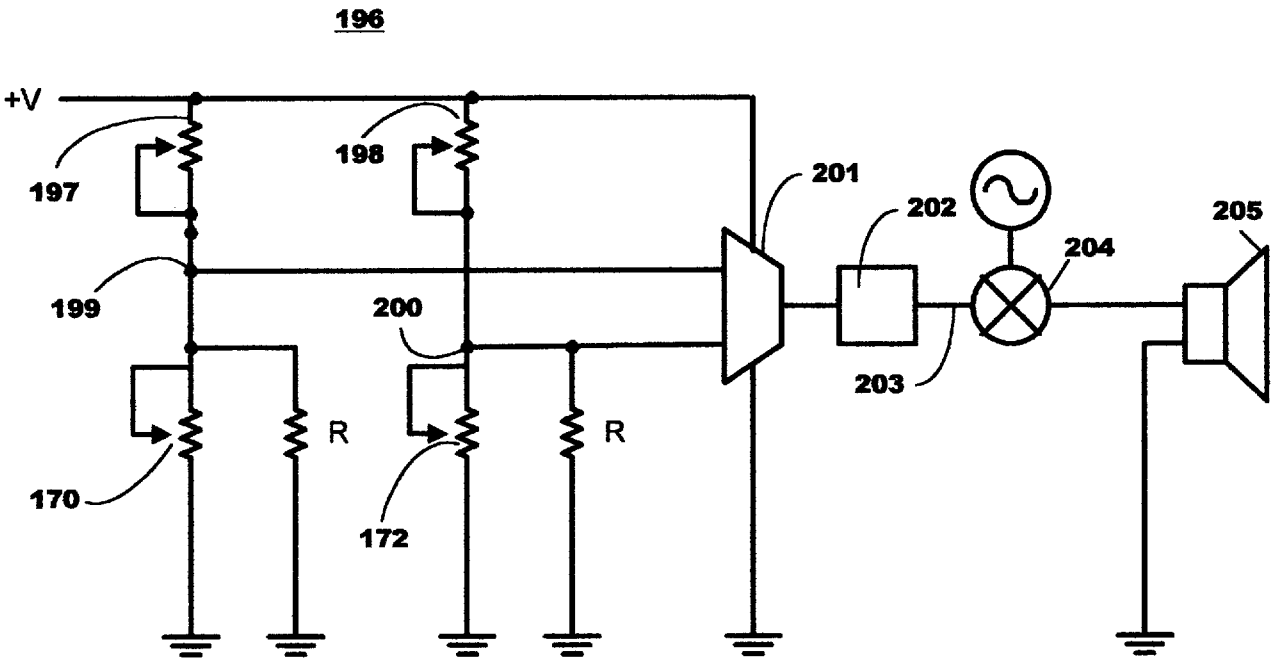
FIG. 10 is a schematic diagram of another forward pressure detection and audio feedback circuit suitable for use with the embodiments of FIGS. 1–7.

FIG. 10 shows a schematic diagram of another control unit 196, in which repeated component numbers identify identical components. Sensors 170,172 are connected in series with biasing resistors 197,198, respectively, to form voltage 199,200, respectively. Voltages 199,200 are coupled to a voltage-to-current converter 201, which produces a variable output current through a variable resistor 202, which variable current is proportional to the difference in force sensed by sensors 170 and 172. A voltage 203 is thereby produced across resistor 202, which voltage 203 controls the output frequency of a voltage controled oscillator 204, VCO. VCO 204 drives a speaker 205 at the output frequency thereby produced. Variation of the resistance value of resistor 202 determines the output frequency range of VCO 204.

In operation, control unit 196 produces an audio feedback signal which varies in pitch in response to the difference in pressure being applied to the sensors 170 and 172. Thus, the actual difference in pressure is reported to the athlete instead of the comparison with a predetermined reference.

A variety of electrical components may be used to construct the control units. A typical comparator such as the LM393 available from a variety of manufacturers exhibits sufficient performance for application in our device. The audio amplifier may be a single transistor with sufficient current rating to drive the transducer. The transducer may be taken from those available for a number of different products including pagers, smoke detectors, etc. If a low power transducer is selected, it is possible to perform the comparator and amplifier functions with a single device such as the LM358.

Figure 11:
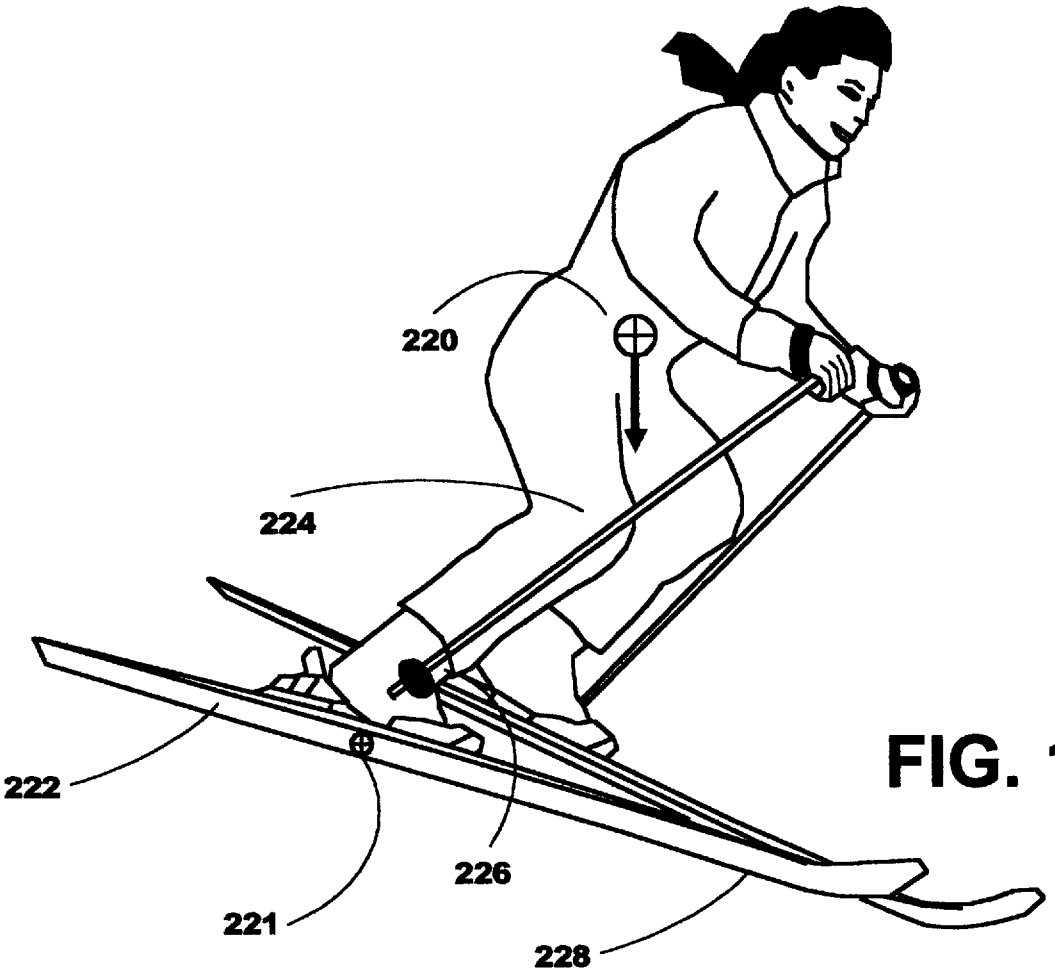
FIG. 11 shows how a skier applies forward pressure to the skis while maintaining an athletic skiing stance.

FIG. 11 shows how a proficient skier balances in an athletic skiing stance with correct forward lean and carves a turn. In this diagram, the skier is turning to her left. The skier's center of mass 220 is located well in front of the center of mass 221 of her turning ski 222. The correctness of her stance produces a strong edge grip of the turning ski into the snow as evidenced by the inclination and reverse camber of the turning ski. This skier's forward stance is achieved through a combination of correct forward lean, correct forward arm positioning and strong flexion of the right knee 224, resulting in strong pressure against the front of her right boot 226. This pressure against the boot translates into pressure on the inside front edge of the turning ski 228, successfully driving it into the snow.

The embodiments described in FIGS. 1, 2, 3 and 4 measure the differential pressure applied by a skier against the front of the boot, providing a signal to the athlete whenever it falls above or below some desired threshold value The invention has been described in sufficient detail to enable one skilled in the art to practice the invention, but variations and modifications within the spirit and scope of the invention may occur to those skilled in the art without departing from the scope of the appended claims. These embodiments describe a very simple and inexpensive device which is useful at a wide variety of skill levels. The present invention provides an effective method for training of a critical aspect of locomotive sports, which aspect can significantly reduce the risk of injury while enhancing skill levels and thereby promoting healthy participation in several sport activities.

What is claimed is:

1. 1. A foot balance training device, comprising:

first and second force sensitive resistors;

means for affixing the first and second force sensitive resistors for sensing forward pressure exerted between a person's foot or leg and footwear means being worn by the person with the first force sensitive resistor, and for sensing rearward pressure exerted between the foot or leg and the footwear means with the second force sensitive resistor;

means responsive to the first and second resistors for comparing the forward and rearward pressure sensed by the first and second resistors by comparing resistance values of the first and second resistors, including threshold means for determining a threshold difference value by which the resistance values of the first and second resistors are compared; and signal means responsive to the means for comparing for communicating to the person wearing the footwear means the greater of either the forward or rearward pressure sensed by the first and second resistors in relation to the threshold difference value.

2. The training device of claim 1, wherein the footwear means is a ski or snow board and the first and second force sensitive resistors are affixed between the ski or snow board and a boot worn by a user of that ski or snow board.

3. The training device of claim 2, wherein the resistors are affixed between a ski and a ski binding.

4. The training device of claim 2, wherein the resistors are affixed between a ski boot and a ski binding.

5. The training device of claim 1, wherein the means for affixing includes a shoe insole adapted to locate the first and second force sensitive resistors under ball and heal portions of a human foot.

6. The training device of claim 1, wherein the means for affixing includes an elastic band adapted for wear around a person's leg between the leg and an upper portion of an athletic boot, and further wherein the first force sensitive resistor is affixed to the elastic band at a location adapted for wear at a front portion of the person's leg and the second force sensitive resistor is affixed to the elastic band at a location adapted for wear at a rear portion of the person's leg.

7. The training device of claim 1, wherein the first and second force sensitive resistors are affixed to upper portions of a boot collar of the footwear means and further wherein the first force sensitive resistor is affixed at a front portion of the person's leg and the second force sensitive resistor is affixed at a rear portion of the person's leg.

8. The training device of claim 7, wherein the footwear means is a ski boot or skate boot.

9. The training device of claim 1, wherein the threshold means is adapted for adjustment during use of the device.

* * * * *